US005595854A

United States Patent [19]

Leenders et al.

[11] Patent Number: 5,595,854

[45] **Date of Patent: *Jan. 21, 1997**

[54] METHOD FOR THE FORMATION OF HEAT MODE IMAGE

[75] Inventors: Luc Leenders, Herentals; Herman Uytterhoeven, Bonheiden; Rita Torfs, Herenthout; Leo Oelbrandt, Kruibeke; Carlo Uyttendaele, Berchem; Jan Van den Bogaert, Schilde, all of Belgium

[73] Assignee: Agfa-Gevaert N.V., Mortsel, Belgium

[ * ] Notice: The term of this patent shall not extend beyond the expiration date of Pat. No. 5,547,809.

[21] Appl. No.: 400,345

[22] Filed: Mar. 8, 1995

[30] Foreign Application Priority Data

Mar. 25, 1994 [EP] European Pat. Off. ..... 94200794

[51] Int. Cl.[6] ..... G03C 8/08

[52] U.S. Cl. ..... 430/200; 430/203; 430/964

[58] Field of Search ..... 430/200, 201, 430/203, 964

[56] References Cited

U.S. PATENT DOCUMENTS 3,218,166 11/1965 Reitter ..... 430/203
3,767,414 10/1973 Huffman et al. ..... 96/114
3,941,596 3/1976 Heiart ..... 430/200
5,380,607 1/1995 Van Houte et al. ..... 430/200

OTHER PUBLICATIONS

"Thermal Dye Transfer" by Janssens et al.; Research Disclosure, vol. 320, No. 19, Dec. 1990, Havant GB; p. 931, left col. last paragraph—right col., second paragraph.

*Primary Examiner*—Richard L. Schilling
*Attorney, Agent, or Firm*—Brumbaugh, Graves, Donohue & Raymond

[57] ABSTRACT

A method is disclosed for the formation of a heat mode image comprising the steps of (i) bringing in close contact a donor element, containing a reducing agent and an radiation to heat converting compound, and an acceptor element, containing a reducible organic silver salt, (ii) exposing this assemblage information-wise by intense infra-red laser radiation, (iii) peeling apart the elements and (iiii) optionally overall heating the separated acceptor element.

In a preferred embodiment the laser is an infra-red laser and the radiation to heat converting compound is an infra-red absorbing compound.

In an alternative embodiment the radiation to heat converting compound is incorporated in the acceptor.

16 Claims, No Drawings

METHOD FOR THE FORMATION OF HEAT MODE IMAGE

DESCRIPTION

1. Field of the Invention

The present invention relates to a method for obtaining a heat mode image.

2. Background of the Invention

Conventional photographic materials based on silver halide are used for a large variety of applications. For instance, in the pre-press sector of graphic arts rather sensitive camera materials are used for obtaining screened images. Scan films are used for producing colour separations from multicolour originals. Phototype setting materials record the information fed to phototype- and image setters. Relative insensitive photographic materials serve as duplicating materials usually in a contact exposure process. Other fields include materials for medical recording, duplicating and hard copy, X-ray materials for non-destructive testing, black-and-white and colour materials for amateur- and professional still photography and materials for cinematographic recording and printing.

Silver halide materials have the advantage of high potential intrinsic sensitivity and excellent image quality. On the other hand they show the drawback of requiring several wet processing steps employing chemical ingredients which are suspect from an ecological point of view. E.g. the commonly used developing agent hydroquinone is a rather unwanted ingredient because of its allergenic effects. The biodegradation of disposed Phenidone is too slow. Sulphite ions show a high COD (Chemical Oxygen Demand) and the resulting sulphate ions are harmful for e.g. concrete. As a consequence it is undesirable that depleted solutions of this kind would be discharged into the public sewerage: they have to be collected and destroyed by combustion, a cumbersome and expensive process.

In the past several proposals have been made for obtaining an imaging element that can be developed using only dry development steps without the need of processing liquids as it is the case with silver halide photographic materials.

A dry imaging system known since quite a while is 3M's dry silver technology. It is a catalytic process which couples the light-capturing capability of silver halide to the image-forming capability of organic silver salts. Traditionally, silver halide, preferably silver bromide, is formed in situ by reacting silver behenate with bromide ions. The result of this process is the formation of very fine grains of silver bromide, less than 500 angstroms in diameter and positioned in catalytic proximity to the silver behenate. Exposure to light causes photolytic reduction at the silver bromide crystal (latent image formation) and provides a silver nucleus in position to permit electron transfer that catalyzes the reduction of the organic silver salt to silver metal at an elevated temperature thus producing a visual density. A disadvantage of this technology that in the non-exposed areas silver halide remains which forms print-out silver on aging thereby increasing the minimal density eventually to an unacceptable level for some purposes. Details on the dry silver technology can be found in U.S. Pat. Nos. 3,457,075, 3,839,049, 4,260,677 and *J. Phot. Sci.*, Vol. 41 (1993) , p. 108.

Another type of non-conventional materials as alternative for silver halide is constituted by so-called photo mode materials based on photopolymerisation. The use of photopolymerizable compositions for the production of images by information-wise exposure thereof to actinic radiation is known since quite a while. All these methods are based on the principle of introducing a differentiation properties between the exposed and non-exposed parts of the photopolymerizable composition e.g. a difference in solubility, adhesion, conductivity, refractive index, tackiness, permeability, diffusibility of incorporated substances e.g. dyes etc. The thus produced differences may be subsequently employed in a dry treatment step to produce a visible image and/or master for printing e.g. a lithographic or electrostatic printing master.

A difference in solubility between the exposed and non-exposed parts of the photopolymerizable composition is often used for the production of lithographic printing plates where a hydrophilic base is coated with the photopolymerizable composition, subsequently exposed and developed using a solvent to remove the non-exposed or insufficiently exposed parts. Such a process is for example described in "Unconventional imaging processes" by E. Brinckman, G. Delzenne, A. Poot and J. Willems, Focal Press London-New York, first edition 1978, pages 33 to 39.

The use of the difference in tackiness to obtain an image is described in e.g. U.S. Pat. Nos. 3,060,024, 3,085,488 and 3,649,268. According to the method disclosed in these US patent applications the image-wise exposed photopolymerizable composition looses its tackiness in the exposed parts while the non-exposed parts keep their tackiness. The non-exposed parts can therefore be colored with dry dye pigments to make the image visible.

According to the methods described in e.g. U.S. Pat. No. 3,245,796and EP-A 362,827 the diffusibility of a dye is impeded in the photo-exposed parts of the photopolymerizable composition so that during an overall thermal heating subsequent to photo-exposure dye substances in the non-exposed areas will be able to diffuse to a receptor material. According to a similar method described in U.S Pat. No. 4,587,198 the photopolymerizable composition is made impermeable in the exposed parts for a sublimable dye or dye-pigment present in a layer adjacent to the layer comprising the photopolymerizable composition.

According to a method disclosed in U.S. Pat. No. 3,060,023 the adhesion of the photopolymerizable composition is modified upon image-wise exposure. After image-wise exposure the non-exposed parts will stick or adhere, during a step cf overall heating, to a receiving sheet thus allowing the transfer of the non-exposed parts to the receiving sheet.

As illustrated above photopolymerization can be used in a variety of methods to reproduce images. Among these methods several are using dry-developing steps for producing the image which is convenient and offers an ecological advantage. However the sensitivity of most photopolymerizable compositions is rather low so that they are e.g. not suitable for use in exposure with laser light sources which are recently widely employed for producing images.

As a further alternative for silver halide chemistry dry imaging elements are known that can be image-wise exposed using an image-wise distribution of heat. These types of dry imaging elements called heat mode materials offer the advantage in addition to an ecological advantage that they do not need to be handled in a dark room nor any other protection from ambient light is needed. Heat mode recording materials are disclosed in e.g. U.S. Pat. No. 4,123,309, U.S. Pat. No. 4,123,578, U.S. Pat. No. 4,157,412, U.S. Pat. No. 4,547,456 and PCT applications WO 88/04237 and WO 93/03928.

The present invention further extents the teachings on heat mode materials.

It is the object of the present invent to provide a method for the formation of a heat mode image involving only dry processing steps.

SUMMARY OF THE INVENTION

The object of the present invention is realized by providing a method for the formation of a heat mode image comprising the steps of:

(1) preparing a donor element by coating on a support one or more donor layers containing, distributed over said one or more layers, a reducing agent, a radiation to heat converting compound, and optionally a polymeric binder;

(2) preparing an acceptor element by coating on a support an acceptor layer containing a reducible organic silver salt and a polymeric binder;

(3) bringing said donor layer and said acceptor layer in close contact with each other;

(4) information-wise exposing the contacting elements with laser radiation, thus inducing the partial or complete transfer of said donor layer(s) to the acceptor element and/or diffusion of said reducing agent into the acceptor element;

(5) peeling apart the donor and acceptor elements;

Preferably the separated acceptor element is subjected to an overall heat treatment.

In an alternative embodiment the acceptor element contains the radiation to heat converting compound. In this case the donor element comprises preferably just one donor layer containing the reducing agent and the acceptor element can comprise one or more acceptor layers. In the latter case the acceptor element preferably comprises a first layer containing the reducible silver salt, and a second layer on top of it comprising the radiation to heat converting compound.

DETAILED DESCRIPTION OF THE INVENTION

First the important ingredients of the donor and the acceptor element will now be explained in detail.

In a preferred embodiment of the present invention the donor element contains a reducing agent, a radiation to heat converting compound and optionally a binder. In a preferred embodiment the radiation to heat converting compound and the reducing agent are simply contained in just one layer. Alternatively they can be distributed over a layer pack, preferably a double layer pack, one layer containing the radiation to heat converting compound, the other containing the reducing agent. In the latter case the radiation to heat converting compound is preferably incorporated in the layer closest to the support through which the laser recording is performed.

Suitable reducing agents for use in the heat mode element include pyrogallol, 4-azeloyl-bis-pyrogallol, 4-stearyl pyrogallol, galloacetophenone, di-tertiary-butyl pyrogallol, gallic acid anilide, methyl gallate, sodium gallate, ethyl gallate, normal- and iso-propyl gallate, butyl gallate, dodecyl gallate, gallic acid, ammonium gallate, ethyl protocatechuate, cetyl protocatechuate, 1-hydroxy-2-naphthoic acid, 2-hydroxy-3-naphthoic acid, phloroglucinol, catechol, 2,3-naphthalene diol, 4-lauroyl catechol, protocatechualdehyde, 4-methyl esculetin, 3,4-dihydroxy benzoic acid and its esters, 2,3-dihydroxy benzoic acid and its esters, 2,5-dihydroxy-benzoic acid and its esters, hydroquinone, t.-butylhydroquinone, isopropylhydroquinone, 2-tetrazolylthiohydroquinonens, e.g., 2-methyl-5-(1-phenyl-5tetrazolylthio) hydroquinone, 5-pyrazolones, 3-pyrazolones, 4,4'-dihydroxy-biphenyl, bis (2-hydroxy-3-t.-butyl-5-methylphenyl-)methane, 2,2-bis (4-hydroxy-3-methylphenyl) propane, 4,4-ethylidene-bis (2-t.-butyl-6-methylphenol) , 2,2-bis(3,5-dimethyl-4-hydroxyphenyl)propane, ascorbic acid and its derivatives, 3,4-dihydroxyphenylacetic acid, 4-(3',4'-dihydroxyphenylazo)benzoic acid, 2,2'-methylene-bis-3,4,5-trihydroxybenzoic acid, ortho-, meta- and para-phenylenediamine, tetramethyl benzidine, 4,4',4"-diethylaminotriphenylmethane, o-, m-, and p-aminobenzoic acid, 4-methoxy-1-hydroxy-dihydronaphthalene and tetrahydroquinoline. Further useful reducing agents comprise aminocycloalkenone compounds, esters of amino reductones, N-hydroxyurea derivatives, hydrazones of aldehyde and ketones, phosphoramidophenols, phosphor amidoanilines, (2,5-dihydroxyphenyl)sulphone, tetrahydroquinoxalines, 1,2,3,4-tetrahydroquinoxaline, amidoximes, azines, hydroxamic acids, sulphonamidophenols, 2-phenylindane-1,3-dione, 1-4-dihydropyridines, such as 2,6-dimethoxy-3,5-dicarbethoxy-1,4-dihydropyridine. Still other useful reducing agents include resorcins, m-aminophenols, α- and β-naphtols, alkylphenols and alkoxynaphtols. A further class of reducing agents is constituted by hydrazine compounds. Especially preferred hydrazine compounds include p-tolylhydrazine hydrochloride, N,N-phenylformylhydrazide, acetohydrazide, benzoylhydrazide, p-toluenesulphonylhydrazide, N,N'-diacetylhydrazine, β-acetyl-phenylhydrazine, etc.

An especially preferred reducing agent is "Spirana", a spiro-bis-indane derivative, disclosed in European patent application Appl. No. 93203120, corresponding to following chemical formula:

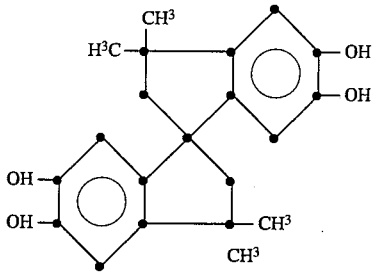

Another most preferred reducing agent for the practice of this invention is ethyl gallate.

In some cases the thermotransferable reducing agent of the donor element will react with the reducible organic silver salt of the acceptor giving rise to a silver image with a non-neutral hue. This can be compensated by using as reducing agent a colour forming reducing agent, the oxidized form of which is coloured-itself or capable of reacting to a colour. This colour should be complementary to the hue of the silver image formed.

Examples of color forming reducing agents of which an oxidized form reacts to form a colour are auto-coupling substances such as 4-methoxy-1-naphtol and indoxyl, and auto-coupling aminophenols, as described in "Chimie photographique" of P. Glafkidés, 2th edition, p. 604.

Colour forming reducing agents having coloured oxidation products are e.g. bisphenols such as described in EP-A-509740.

Highly preferred colour forming reducing agents are reduced forms of indoaniline or azomethine dyes i.e. leuco-indoanilines or leuco-azomethine dyes. Particularly preferred are leuco-indoanilines corresponding to the following general formula (CRFA):

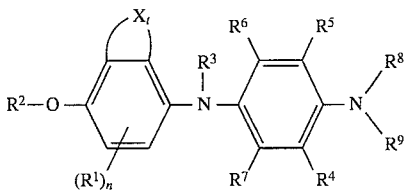

CFRA wherein:

$R^1$ represents hydrogen or any substituent, n is zero or a positive integer chosen from 1 to 4, and when n is 2, 3, or 4, $R^1$ has same or different significance, each of $R^2$ and $R^3$ independently represents hydrogen or an acyl group chosen from the group of $—COR^{10}$, $—SO_2R^{10}$, and $—OPR^{10}R^{11}$, X represents the atoms needed to complete a fused-on ring, t is 0 or 1, each of $R^4$, $R^5$, $R^6$, and $R^7$ independently represents hydrogen, an alkyl group, a cycloalkyl group, an aryl group, an alkyloxy group, an aryloxy group, a carbamoyl group, a sulphamoyl group, a hydroxy, a halogen atom, $—NH—SO_2R^{12}$, $—O—SO_2R^{12}$, or $—O—COR^{12}$, or $R^4$ and $R^7$ together or $R^5$ and $R^6$ together represent the atoms necessary to complete an aliphatic ring or a heterocyclic ring, or $R^4$ and $R^8$ or $R^5$ and $R^9$ together represent the atoms necessary to complete a heterocyclic ring, each of $R^8$ and $R^9$ independently represents hydrogen, an alkyl group, a cycloalkyl group, an aryl group, a heterocyclic ring or $R^8$ and $R^9$ together represent the atoms necessary to complete a heterocyclic ring, each of $R^{10}$, $R^{11}$, and $R^{12}$ independently represents an alkyl group, a cycloalkyl group, an aryl group, an alkyloxy group, an aryloxy group, an alkylthio group, an arylthio, an amino group or a heterocyclic ring.

A non-exhaustive list of leuco-indoanilines corresponding to the general formula I is given hereinafter.

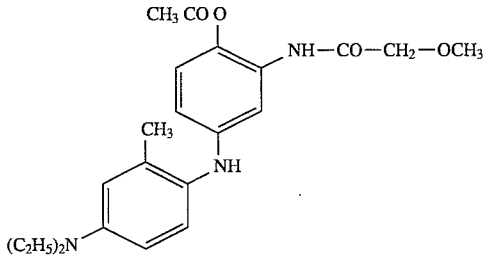

CRFA-1

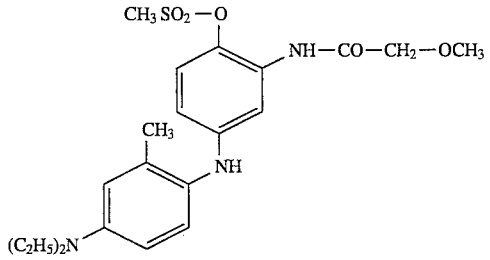

CRFA-2

-continued

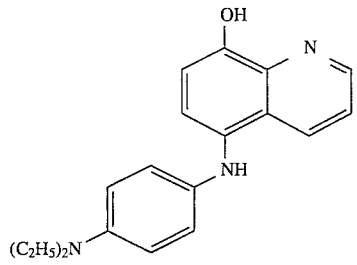

CRFA-3

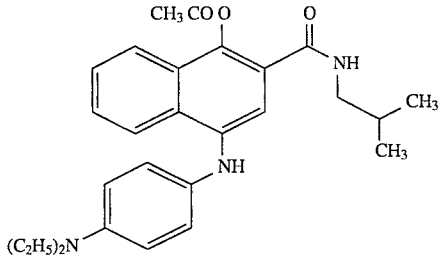

CRFA-4

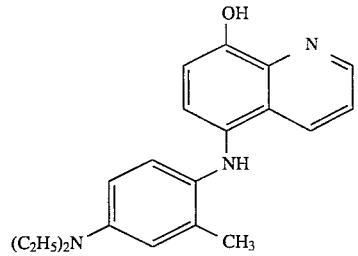

CRFA-5

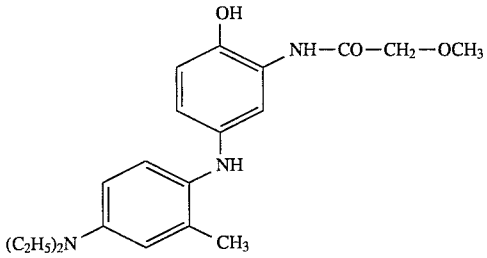

CRFA-6

The compounds corresponding to the above general formula can be prepared by reducing the corresponding dye and, if necessary, derivatizing the leuco dye with acyl chlorides.

Other preferred forms of leuco-azomethines are described in RD 22623 (February 1983), EP 0 533 008, EP 512 477, RD 21003 (October 1981) and EP 0069 585.

The radiation to heat converting substance present in the donor transforms the information-wise modulated laser exposure into an information-wise modulated pattern of heat. In a most preferred embodiment the laser is an infra-red laser and the radiation to heat converting substance is an infra-red absorbing compound. This infrared absorbing compound can be a soluble infra-red absorbing dye or a dispersable infra-red absorbing pigment. Infra-red absorbing compounds are known since a long time and belong to several different chemical classes, e.g. indoaniline dyes, oxonoldyes, porphine derivatives, anthraquinone dyes, merostyryl dyes, pyrylium compounds and sqarylium derivatives.

A suitable infra-red dye can be chosen from the numerous disclosures and patent applications in the field, e.g., from. U.S. Pat. Nos. 4,886,733, 5,075,205, 5,077,186, 5,153,112, 5,244,771, from Japanese unexamined patent publications (Kokai) No.'s 01-253734, 01-253735, 01-253736, 01-293343, 01-234844, 02-3037, 02-4244, 02-127638, 01-227148, 02-165133, 02-110451, 02-234157, 02-223944, 02-108040, 02-259753, 02-187751, 02-68544, 02-167538, 02-201351, 02-201352, 03-23441, 03-10240, 03-10239, 03-13937, 03-96942, 03-217837, 03-135553, 03-235940, and from the European published patent application No.'s 0 483 740, 0 502 508, 0 523 465, 0 539 786, 0 539 978 and 0 568 022. This list is far from exhaustive and limited to rather recent disclosures.

In a preferred embodiment the infra-red dye is chosen from German patent application DE 43 31 162.

Actual useful infra-red dyes are listed below:

ID-1 is a commercial product known as CYASORB IR165, marketed by American Cyanamid Co, Glendale Protective Technologie Division, Woodbury, N.Y. It is a mixture of two parts of the molecular non-ionic form (ID-1a) and three parts of the ionic form (ID-1b) represented by:

ID-1a

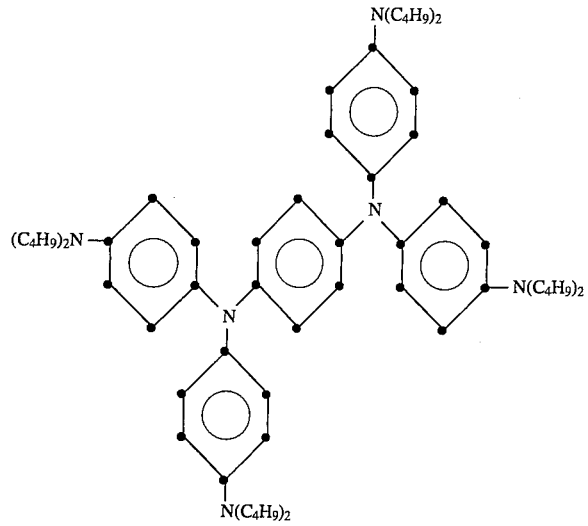

ID-1b

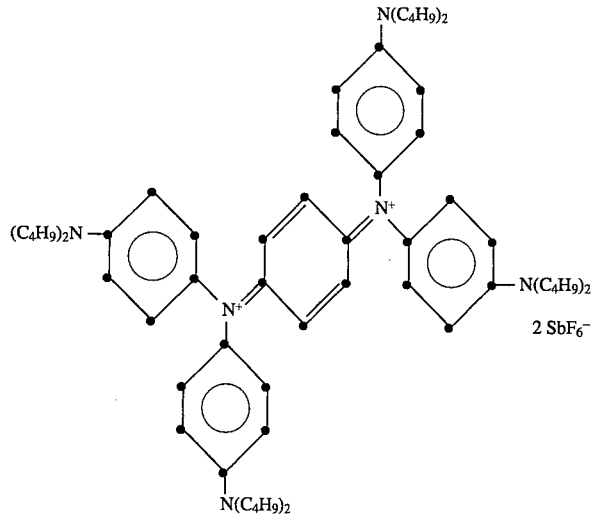

ID-2

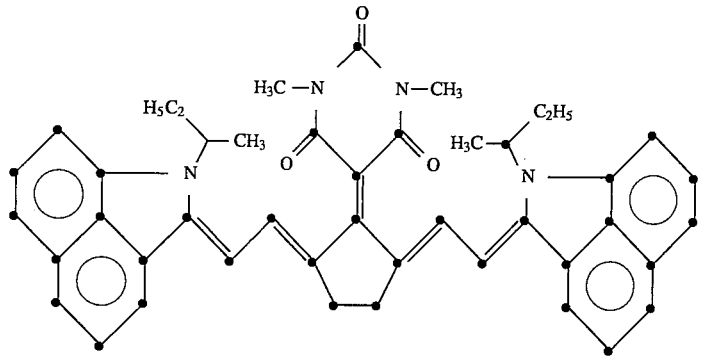

-continued

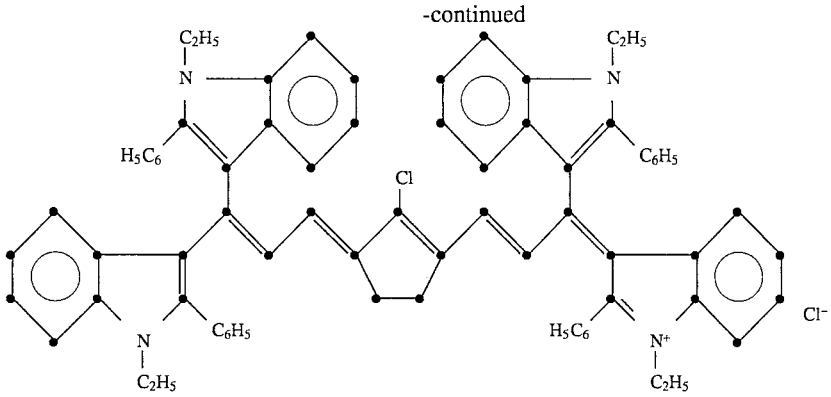

ID-3

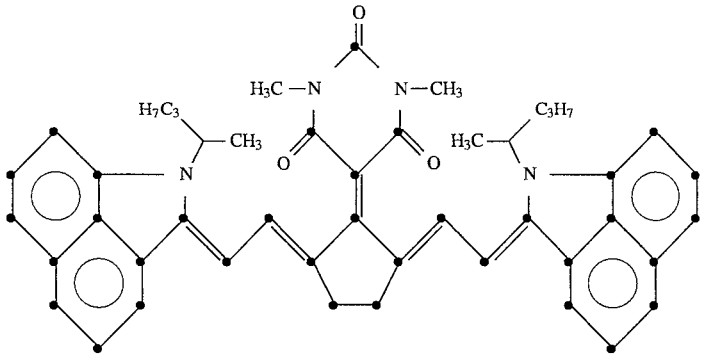

ID-4

The concentration of the infra-red absorbing dye is preferably comprised between 0.05 and 3 mmole/$m^2$. The optimal concentration is dependent self-evidently on its extinction coefficient at the laser emission wavelenght.

Apart from infra-red dyes, dispersable infra-red absorbing pigments can be used. This pigments can be coloured, e.g. phtalocyanine pigments. However the most preferred pigment is carbon black, absorbing in the infra-red and the visible spectral region. It can be used in the amorphous or in the graphite form. The preferred average particle size of the carbon black ranges from 0.01 to 1 μm. Different commercial types of carbon black can be used, preferably with a very fine average particle size, e.g., RAVEN 5000 ULTRA II (Columbian Carbon Co.), CORAX L6, FARBRUSS FW.200, SPEZIALSCHWARZ 5, SPEZIALSCHWARZ, 4A, SPEZIALSCHWARZ 250 and PRINTEX U (all from Degussa Co.).

The total coverage of the donor layer(s) is preferably comprised between 0.5 and 10 g/$m^2$.

The most important ingredient of the acceptor layer of the acceptor element is the reducible organic silver salt. Substantially light-insensitive organic silver salts particularly suited for use according to the present invention in the heat-sensitive recording layer are silver salts of aliphatic carboxylic acids known as fatty acids, wherein the aliphatic carbon chain has preferably at least 12 C-atoms, e,g. silver laurate, silver palmitate, silver stearate, silver hydroxystearate, silver oleate and silver behenate. Silver salts of modified aliphatic carboxylic acids with thioether group as described e.g. in GB-P 1,111,492 and other organic silver salts as described in GB-P 1,439,478, e.g. silver benzoate and silver phthalazinone, may be used likewise. Further can be used silver salts of aromatic carboxylic acids (e.g. benzoic acid, phtalicacid, terephtalic acid, salicylic acid, m-nitrobenzoic-, phenylacetic-, pyromellitic-, p-phenylbenzoic-, camphoric-, huroic-, acetamidobenzoic- and o-aminobenzoic acid, etc.). Furtheron can be used silver salts of mercapto group- or thione group-containing compounds (e.g., 3-mercapto-4-phenyl-1,2,4-triazole, 2-mercaptobenzimidazole, etc.) or an imino group-containing compound (e.g. benzotriazole or derivatives thereof as described in GB 1,173,426 and U.S. Pat. No. 3,635,719, etc.). Further can be mentioned silver imidazolates and the substantially light-insensitive organic silver salt complexes described in U.S. Pat. No. 4,260,677.

In a most preferred embodiment of the present invention the organic silver salt is silver behenate. The compound is colourless, visibly stable toward light, insoluble in many volatile liquid vehicles, and moisture-resistant. It is produced in the desired physical form without difficulty and at reasonable cost.

The acceptor layer and optionally the donor layer(s) contain a binder. Suitable binders include cellulose derivatives, such as ethyl cellulose, hydroxyethyl cellulose, ethylhydroxy cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from (meth) acrylates and (meth)acrylate derivatives, such as polyacrylic acid, polymethyl methacrylate and styrene-acrylate copolymers; polyester resins; polycarbonates; copoly(styrene-acrylonitrile); polysulfones; polyphenylene oxide; organosilicones such as poly-siloxanes; epoxy resins and natural resins, such as gum arabic. When using copoly(stryrene-acrylonitrile) the copolymer preferably comprises at least 65% by weight of styrene units and at least 25% by weight of acrylonitrile units, but other comonomers can be present, e.g., butadiene, butyl acrylate and methyl methacrylate.

Another preferred type of binder is a polycarbonate derived from a bis-(hydroxyphenyl)-cycloalkane, corresponding to following general formula:

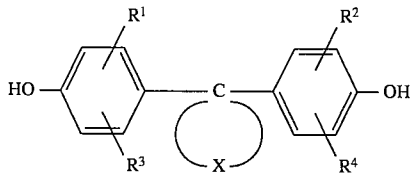

wherein:

$R^1$, $R^2$, $R^3$, and $R^4$ each independently represents hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group, and X represents the atoms necessary to complete a 5- to 8-membered alicyclic ring, optionally substituted with a $C_1$–$C_6$ alkyl group, a 5- or 6-membered cycloalkyl group or a fused-on 5- or 6-membered cycloalkyl group.

Examples of such a compound are a polycarbonate-(coded PC1 in the examples further on) based on phosgene and 1,1-bis-(4-hydroxyphenyl)-3,3,5-trimethylcyclohexane, and a polycarbonate (coded PC2) based on phosgene and a mixture of 1,1-bis-(4-hydroxyphenyl)-3,3,5-trimethylcyclohexane and bisphenol A.

In order to obtain a neutral black image to be in the higher densities and neutral grey in the lower densities the acceptor layer further preferably can contain a so-called toning agent known from thermography or photo-thermography. The incorporation of a toning agent or toner constitutes an alternative for the use of a reducing agent forming a colour complementary to the hue of the silver image, as described above.

Suitable toning agents are the phthalimides and phthalazinones within the scope of the general formulae described in U.S. Pat. No. Re. 30,107. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type within the scope of following general formula:

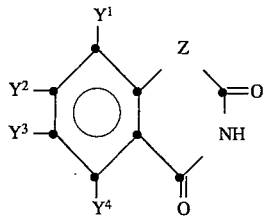

wherein

Z represents O or N-alkyl;

each of $Y^1$, $Y^2$, $Y^3$ and $Y^4$ (same or different) represents hydrogen, alkyl, e.g. $C_1$–$C_{20}$ alkyl, preferably $C_1$–$C_4$ alkyl, cycloalkyl, e.g. cyclopentyl or cyclohexyl, alkoxy, preferably methoxy or ethoxy, atkylthio with preferably up to 2 carbon atoms, hydroxy, dialkylamino of which the alkyl groups have preferably up to 2 carbon atoms or halogen, preferably chlorine or bromine; or $Y^1$ and $Y^2$ or $Y^2$ and $Y^3$ represent the ring members required to complete a fused aromatic ring, preferably a benzene ring, or $Y^3$ and $Y^4$ represent the ring members required to complete a fused-on aromatic or cyclohexane ring. Toners within the scope of said general formula are described in GB-P 1,439,478 and U.S. Pat. No. 3,951,660.

A toner compound particularly suited for use in combination with polyhydroxy spiro-bis-indane reducing agents like "Spirana" is 3,4-dihydro-2,4-dioxo-1,3,2H-benzoxazine described in U.S. Pat. No. 3,951,660.

In an alternative embodiment the acceptor element contains the radiation to heat converting compound. In this case the donor element comprises preferably just one donor layer containing the reducing agent and the acceptor element can comprise one or more acceptor layers. In the latter case the acceptor element, preferably comprises a first layer containing the reducible silver salt, and a second layer on top of it comprising the radiation to heat converting compound.

It is clear that the support of the element through which non-coated side the laser exposure is made must be transparent to the laser radiation. In other words, when the laser recording is made through the backside of the donor, then the support of the acceptor must be transparent and the support of the acceptor can be transparent or opaque. Alternatively, when the laser recording is made through the backside of the acceptor, then the support of the acceptor must be transparent and the support of the donor can be transparent or opaque. In a preferred embodiment both supports are transparent, especially when the obtained silver image in the acceptor serves as an intermediate for further exposure, e.g., of a printing plate. When a paper support is used preference is given to one coated at one or both sides with an α-olefin polymer, e.g. a polyethylene layer which optionally contains an anti-halation dye or pigment. A transparent organic resin support can be chosen from, e.g., cellulose nitrate film, cellulose acetate film, polyvinyl acetal film, polystyrene film, polyethylene terephthalate film, polycarbonate film, polyvinylchloride film or poly-α-olefin films such as polyethylene or polypropylene film. The thickness of such organic resin film is preferably comprised between 0.05 and 0.35 mm. These organic resin supports are preferably coated with a subbing layer. The most preferred transparent support is a polyethylene terephthalate support.

Before exposure the donor element and the acceptor element must be brought in close contact with each other. This can be done by different procedures, e.g., (a) the elements can simply be pressed together by vacuum suction, (b) the elements can be laminated to each other optionally by the application of heat, or (c) either the acceptor or the donor can be provided with a thin adhesive layer on top of it so that they can be pressed together in a laminator without the need for vacuum suction.

When carrying no adhesive layer the acceptor can be provided with a protective layer. This layer increases the scratch resistance of the acceptor as long it is a separate element. Self-evidently, the thickness of this protective layer is preferably not higher than about 1 $g/m^2$ in order not to impair the diffusibility of the thermotransferred reducing agent into the acceptor layer at the exposed areas. This protective layer can contain binders such as polyvinylbutyral, ethyl cellulose, cellulose acetate propionate, cellulose acetate butyrate, cellulose diacetate, polyvinylchloride, copolymers of vinylchloride, vinylacetate and vinylalcohol, aromatic or aliphatic copolyesters, polymethylmethacrylate, and polycarbonates such as PC1 and PC2 as defined above.

The optional adhesive layer in case of procedure (c) can contain a thermoadhesive substance or a pressure-sensitive adhesive. Preferred thermoadhesive polymers are styrene-butadiene latices. These latices can contain other comonomers which improve the stablitity of the latex, such as acrylic acid, methacrylic acid and acrylamide. Other possible polymer latices include polyvinylacetate, copoly(ethylene-vinylacetate), copoly(acrylonitrile-butadiene-acrylic acid), copoly(styrene-butylacrylate), copoly(methylmethacrylate-butadiene), copoly(methylmethacrylate-butylmethacrylate), copoly(methylmethacrylate-ethylacrylate), copolyester(terephtalic acid-sulphoisophtalic acid-ethyleneglycol), copolyester(terephtalic acid-sulphoisophtalic acid-hexanediol-ethyleneglycol). Particularly suitable thermoadhesive polymers are the BAYSTAL polymer types, marketed by Bayer AG, which are on the basis of styrene-butadiene copolymers. Different types with different physical properties are available. The styrene content varies between 40 and 80 weight %, while the amount of butadiene varies between 60 and 20 weight %; optionally a few weight % (up to about 10%) of acrylamide and/or acrylic acid can be present. Most suited are e.g. BAYSTAL KA 8558, BAYSTAL KA 8522, BAYSTAL S30R and BAYSTAL P1800 because they are not sticky at room temperature when used in a thermoadhesive layer. Other useful polymers are the EUDERM polymers, also from Bayer AG, which are copolymers comprising n.-butylacrylate, methylmethacrylate, acrylonitrile and small amounts of methacrylic acid.

Pressure-sensitive adhesives are those polymers-having a glass transition temperature lower than room temperature.

After the donor and acceptor are brought in close contact this assemblage is information-wise exposed by means of an intense laser beam. Such a laser can be an Ar ion laser, a HeNe laser, a Kr laser, a frequency doubled Nd-YAG laser, a dye laser emitting in the visual spectral region. However in the preferred embodiment where the radiation to heat converting compound is an infra-red absorbing compound the laser is an infra-red laser. Especially preferred lasers are semiconductor diode lasers or solid state lasers such as a Nd-YAG laser emitting at 1064 nm, or a Nd-YLF laser emitting at 1053 nm. Other possible infra-red laser types include diode lasers emitting at 823 nm or diode lasers emitting at 985 nm. A series of lasers can be used arranged in a particular array. Important parameters of the laser recording are the spot diameter (D) measured at the $1/e^2$ value of the intensity, the applied laser power on the film (P), the recording speed of the laser beam (v) and the number of dots per inch (dpi).

As a consequence of the transformation of radiation into heat at the exposed areas, and depending on the particular composition of the elements, the donor layer(s) is (are) partially or completely transferred to the acceptor and remain(s) adhered to it after separation of the elements, and/or the reducing agent diffuses into the acceptor layer thereby inducing the reduction of the organic silver salt. By varying the intensity of and/or the time of laser irradiation the produced amount of heat can be modulated and in this way the amount of reducing agent transferred. In this way a series of intermediate grey levels can be obtained.

The peeling apart of the elements can be performed by hand or by mechanical means.

Since at this stage the thermal reduction of the organic silver salt is far from complete an overall heat treatment of the separated acceptor element is needed for obtaining a sufficient optical density. An optimal overall heating lasts at least 2 s, preferably about 10 s at about 118° C. At lower temperatures the heating time is longer and vice versa.

The obtained heat mode image can be used as an intermediate for the UV-exposure of a UV-sensitive element, e.g., a printing plate or a silver halide contact material. In both cases the heat mode image forms an alternative for a conventional developed silver halide imge-setting film. On the other hand the obtained heat mode image can be meant for direct visual inspection, e.g., in case of proofing purposes or in case of recording of radiographic information.

The following examples illustrate the present invention without however limiting it thereto.

EXAMPLES

EXAMPLE 1

Preparation of the Acceptor Element

A coating composition was prepared as follows. Silver behenate was dispersed together with a solution of polyvinylbutyral in methylethyl ketone in a ball mill. To this dispersion the other ingredients were added so that after coating on a transparent subbed polyethylene terephthalate support by means of doctor blade coating, and drying, these layers contained the following substances:

silver behenate, 4.42 g/m$^2$;

polyvinylbutyral (BUTVAR B79, Monsanto), 4.42 g/m$^2$;

tone modifier 3,4-dihydro-2,4-dioxo-1,3,2H-benzoxazine, 0.34 g/m$^2$ dimethylsiloxane polymer, 0.025 g/m$^2$.

Preparation of Donor Elements

A series of donor elements with different reducing agents and different binders were prepared. Their coating solutions all contained a mixture of 1.0 g/m$^2$ of the infra-red dye ID-1a and of 1.5 g/m$^2$ of the infra-red dye ID-1b (non-ionic and ionic form of the same molecule). As explained already in the description this mixture is known as CYASORB IR165, marketed by American Cyanamid Co, Glendale Protective Technologie Division, Woodbury, N.Y. The reducing agents, binders, and their concentrations (g/m$^2$) are listed in table 1. The ingredients were dissolved in methylethyl ketone. The coating solutions were applied onto a transparent subbed polyethylene terephthalate base having a thickness of 100 μm by means of a doctor blade technique, and the layers were dried. The acceptor element was pressed under vacuum suction to each donor element and these assemblages were exposed information-wise by a Nd-YLF laser through the support of the acceptor. The specifications of the laser recording were : P=217 mW, D =18.2 μm, v=2.2 m/s and 2400 dpi. After recording the donor element and the acceptor element were peeled apart and the acceptor was uniformly heated for 10 s at 118° C. The optical densities (O.D.) of recorded full areas were measured by means of a MACBETH type TD904 densitometer through a UV filter and are represented in table 1.

TABLE 1

| No | Reducing agent | g/m$^2$ | binder* | g/m$^2$ | O.D. |
|---|---|---|---|---|---|
| 1 | ethyl gallate | 2.21 | BUTVAR | 1.31 | 3.4 |
| 2 | " | " | PMMA | 1.31 | 3.0 |
| 3 | gallic acid | 1.93 | BUTVAR | 1.32 | 3.8 |
| 4 | catechol | 1.25 | BUTVAR | 1.35 | 3.2 |
| 5 | " | " | PC2 | 1.35 | 2.6 |
| 6 | " | " | CDA | 1.35 | 2.8 |
| 7 | Spirana | 3.60 | CDA | 1.25 | 2.0 |

*abbrevations:
PMMA: polymethylmethacrylate
CDA: cellulose diacetate
BUTVAR and PC2: see description As can be seen from table 1 all combinations of reducing agents and binders gave rise to good optical densities.

EXAMPLE 2

A new series of donor elements were prepared in a way similar to example 1 wherein the different binders were chosen from an even more extended list. All samples contained 1.0 g/m$^2$ of ethyl gallate, and 0.11 g/m$^2$ of ID1a and 0.17 g/m$^2$ of ID-1b and 0.2 g/m$^2$ of the binders listed in table 2. Each donor element was pressed against the acceptor element and the laser recording was performed through the support of the donor with following specifications : P=300 mW, D=14.9 μm, v=8.8 m/s, 3600 dpi. The further processing was identical to the previous example. The different binders and the obtained optical densities are represented in table 2:

TABLE 2

| No. | binder type | O.D. |
|---|---|---|
| 1 | polyvinylbutyral (BUTVAR) | 3.36 |
| 2 | polycarbonate (PC2) | 3.45 |
| 3 | polymethylmethacrylate | 3.66 |
| 4 | copoly(styrene-acrylonitrile) | 3.42 |
| 5 | cellulose acetate butyrate | 3.64 |
| 6 | cellulose acetate propionate | 3.29 |
| 7 | ethyl cellulose | 3.40 |
| 8 | polyester | 3.63 |
| 9 | polyvinylchloride | 3.66 |
| 10 | polyvinyl acetate | 3.38 |
| 11 | copoly(vinylchloride-vinylacetate) | 3.37 |
| 12 | polyethyleneoxide | 3.06 |
| 13 | polysulphonamide | 3.31 |

As can be seen from the table, good optical densities were obtained with all kinds of binder.

EXAMPLE 3

Two donor elements were prepared in a way similar to example 2 No. 3, wherein the thickness of the PET support was 63 μm and 175 μm respectively. The acceptor and the processing procedure were identical to those of example 2.

With both variants good densities were obtained.

EXAMPLE 4

Another series of donor elements was prepared wherein the chemical nature and the concentration of the infra-red absorbing compound was varied. The reducing agent was ethyl gallate in varying concentration. The acceptor element and the processing were the same as in the previous examples. The laser recording was performed through the support of the donor at following specifications : P=1.23 W, D=18 μm, v=32 m/s, 2400 dpi. The composition of the donor samples and the obtained optical densities are represented in table 3.

TABLE 3

| No. | g/m$^2$. eth. gall. | binder, | g/m$^2$ | ID, | g/m$^2$ | O.D. |
|---|---|---|---|---|---|---|
| 1 | 0.35 | — | | 1a + 1b, | 0.08 + 0.12 | 2.4 |
| 2 | 0.70 | — | | " | " | 3.5 |
| 3 | 1.05 | — | | " | 0.12 + 0.18 | 3.78 |
| 4 | 2.52 | — | | " | 0.16 + 0.24 | 4.02 |
| 5 | 0.7 | — | | ID-3 | 0.07 | 1.8 |
| 6 | 0.7 | — | | " | 0.17 | 3.0 |
| 7 | 1.05 | — | | " | 0.14 | 3.74 |
| 8 | 2.52 | — | | " | 0.14 | 4.15 |
| 9 | 2.52 | — | | " | 0.35 | 4.26 |
| 10 | 1.05 | — | | ID-4 | 0.14 | 3.74 |
| 11 | 1.05 | — | | ID-2 | 0.14 | 3.94 |

TABLE 3-continued

| No. | g/m$^2$. eth. gall. | binder, | g/m$^2$ | ID, | g/m$^2$ | O.D. |
|---|---|---|---|---|---|---|
| 12 | 1.05 | BUTVAR, | 0.18 | " | 0.07 | 3.25 |
| 13 | " | " | 0.52 | " | " | 2.65 |
| 14 | " | PC2 | 0.18 | " | " | 3.00 |
| 15 | " | " | 0.52 | " | " | 2.71 |
| 16 | " | PMMA, | 0.18 | " | " | 3.36 |
| 17 | " | " | 0.52 | " | " | 3.48 |
| 18 | " | SAN* | 0.18 | " | " | 3.14 |
| 19 | " | " | 0.52 | " | " | 2.25 |

*: SAN: co(styrene-acrylonitrile)

As the table shows high optical densities are obtained when the concentration of the reducing agent in the donor is sufficiently high, namely at least 0.7 g/m$^2$. The chemical nature of the infra-red absorber is less significant. Important is a sufficient concentration. The influence of the binder concentration on the optical density is not significant. High concentrations of BUTVAR, PC2 and SAN give rise to lower optical densities.

EXAMPLE 5

Another series of donor elements were prepared similar to the previous examples with the exception that as radiation to heat converting compound a carbon black dispersion was used (CORAX L6 in methylethyl ketone, 10%). The acceptor and the processing were the same as in the previous examples. The composition and the obtained optical densities are summarized in table 4:

TABLE 4

| No. | red. ag. | g/m$^2$ | binder | g/m$^2$ | C g/m$^2$ | O.D. |
|---|---|---|---|---|---|---|
| 1 | ethyl gallate | 2.20 | PC2 | 1.32 | 0.76 | 3.70 |
| 2 | gallic acid | 1.94 | " | " | 2.60 | 3.60 |
| 3 | " | " | " | " | 0.76 | 2.70 |
| 4 | spirana | 5.20 | BUTVAR | 1.32 | 2.60 | 3.40 |

A futher series of donor elements were prepared wherein the carbon dispersion was coated in a first layer onto the support and the reducing agent was incorporated in a second separated layer. The acceptor element and the processing were the same again as in the previous examples. The composition of the donor layers and the obtained optical densities are illustrated in table 5:

TABLE 5

| | layer 1 | | | layer 2 | | | | |
|---|---|---|---|---|---|---|---|---|
| No | g/m$^2$ C | binder | g/m$^2$ | red. ag. | g/m$^2$ | binder | g/m$^2$ | O.D. |
| 1 | 1.1 | — | — | eth. gall. | 2.14 | — | — | 4.10 |
| 2 | 0.7 | NC* | 0.3 | eth. gall. | 1.05 | PMMA | 0.2 | 3.35 |
| 3 | 0.7 | NC | 0.3 | eth. gall. | 1.4 | PMMA | 0.2 | 3.27 |

*: nitrocellulose

The laser recording was performed through the support of the donor and the specifications were P=652 mW, D=29.2 μm, v=2.2 m/s, 1500 dpi.

Good optical densities were obtained both with the single layer donor and with the double layer donor.

EXAMPLE 6

A donor element was prepared containing 1.05 g/m$_2$ of ethyl gallate, 0.2 g/m$^2$ of binder PMMA, 0.11 g/m$^2$ of ID1a and 0.17 g/m$^2$ of ID-1b. The acceptor element contained an acceptor layer identical to the one of the previous examples. On top of the acceptor layer a protective layer was coated containing different polymers as indicated in table 6. Each donor and the acceptor were pressed together under vacuum suction. The laser recording was performed through the donor with following specifications : P=300 mW, D=4.9 μm, v=8.8 m/s, 3600 dpi. The composition of the protective layers and the obtained optical densities are summarized in table 6.

TABLE 6

| No. | polymer type | g/m$^2$ | O.D. |
|---|---|---|---|
| 1 | — | — | 3.7 |
| 2 | ethyl cellulose | 0.2 | 3.2 |
| 3 | " | 0.4 | 3.3 |
| 4 | " | 1.0 | 3.2 |
| 5 | CDA | 0.2 | 2.0 |
| 6 | " | 0.4 | 2.0 |
| 7 | PC2 | 0.2 | 2.9 |
| 8 | " | 0.4 | 2.0 |
| 9 | " | 1.0 | 1.8 |
| 10 | PC1 | 0.2 | 2.5 |
| 11 | " | 0.4 | 1.8 |
| 12 | " | 1.0 | 1.0 |

It was established that the scratch resistance of the acceptors having a protective layer was drastically improved. The optical density is only slightly decreased by the use of protective layers containing ethyl cellulose. For the protective layers with other binders a decrease of optical density was observed when using thick protective layers.

EXAMPLE 7

A series of donor elements was prepared similar to example 2, No. 3 with the exception that an adhesive layer was applied on top of these donors. These adhesive layers contained varying concentrations of copoly(butylacrylate-vinyl acetate), coated from an iso-propylacetate solution (see table 7). The acceptor element was the same as in example 1. In a laminatot the acceptor and the donor were adhered to each other providing a very good physical contact. The laser recording was performed through the support of the donor and the specifications were the same as in example 2. The optical densities are illustrated in table 7:

TABLE 7

| No. | g/m$^2$ polymer | O.D. |
|---|---|---|
| 1 | 0.12 | 3.4 |
| 2 | 0.24 | 3.1 |
| 3 | 0.48 | 3.5 |
| 4 | 0.60 | 3.5 |
| 5 | 1.20 | 2.9 |
| 6 | 1.80 | 2.9 |

After manual peeling apart and heat treatment of the acceptor (10 s at 118° C.) a good optical density was obtained. Less physical image deficiencies were observed than in the previous examples due to the close and homogeneous contact during the transfer of the reducing agent. In case of the thicker adhesive layers a slight decrease in density occurred due to reduced diffusion of the reducing agent into the silver behenate containing acceptor layer.

EXAMPLE 8

The donor element was identical to the one described in example 2, No. 3. To an acceptor element as described in example 1 a thermoadhesive or pressure-sensitive adhesive layer was applied as indicated in table 8. In experiments No. 1 and 2 the acceptor and donor layers were laminated to each other at 50° C. In experiment 3 donor and acceptor were laminated at room temperature. The laser recording specifications were the same as in example 2. The composition of the adhesive layers and the obtained optical densities are illustrated in table 8:

TABLE 8

| No. | polymer type | g/m$^2$ | O.D. |
|---|---|---|---|
| 1 | BAYSTAL T425C* | 1.0 | 3.1 |
| 2 | " | 2.5 | 2.8 |
| 3 | copoly(bu.acr.-vi.ac.)** | 2.4 | 2.5 |

*: a copolymer latex of butadiene, styrene and acrylic acid, marketed by Bayer AG.
**: copoly(butylacrylate-vinylacetate) coated from a isopropylacetate solution.

After manual peeling apart and overall heating of the. acceptor images with a good optical densities, especially at low thickness of the adhesive layer, and with few physical image deficiencies were obtained.

We claim:

1. Method for the formation of a heat mode image comprising the steps of:

(1) preparing a donor element by coating on a support one or more donor layers containing, distributed over said one or more layers, a reducing agent, a radiation to heat converting compound, and optionally a polymeric binder;

(2) preparing an acceptor element by coating on a support an acceptor layer containing a reducible organic silver salt and a polymeric binder;

(3) bringing said donor element and said acceptor element in close contact with each other;

(4) information-wise exposing the contracting elements with laser radiation, thus inducing the partial or complete transfer of said donor layer(s) to the acceptor element and/or diffusion of said reducing agent into the acceptor element;

(5) peeling apart the donor and acceptor elements; and (6) subjecting the separated acceptor element to an overall heat treatment.

2. Method for the formation of a heat mode image comprising the steps of:

(1) preparing a donor element by coating on a support a donor layer containing a reducing agent and optionally a polymeric binder;

(2) preparing an acceptor element by coating on a support one or more acceptor layers containing, distributed over said one or more layers, a reducible organic silver salt, a radiation to heat converting compound and a polymeric binder;

(3) bringing said donor element and said acceptor element in close contact with each other;

(4) information-wise exposing the contracting elements with laser radiation, thus inducing the partial or complete transfer of said donor layer(s) to the acceptor element and/or diffusion of said reducing agent into the acceptor element;

(5) peeling apart the donor and acceptor elements; and (6) subjecting the separated acceptor element to an overall heat treatment.

3. Method according to claim 1 wherein said organic silver salt is silver behenate.

4. Method according to claim 1 or 2 wherein said radiation to heat converting compound is carbon black.

5. Method according to claim 1 or 2 wherein said laser radiation is infra-red laser radiation and said radiation to heat converting compound is an infra-red absorbing compound.

6. Method according to claim 5 wherein said infra-red absorbing compound is an infra-red absorbing dye.

7. Method according to claim 5 wherein said infra-red absorbing compound is an infra-red absorbing pigment.

8. Method according to claim 1 or 2 wherein said reducing agent is ethyl gallate.

9. Method according to claim 1 or 2 wherein said polymeric binder is chosen from the group consisting of poly-(vinylbutyral), a copolymer of vinylbutyral, polymethylmethacrylate, a polycarbonate or a cellulose derivative.

10. Method according to claim 1 or 2 wherein the oxidized form of said reducing agent is coloured or capable of reacting to a colour.

11. Method according to claim 1 or 2 wherein said acceptor element further comprises a protective layer applied on top of it.

12. Method according to claim 1 or 2 wherein said acceptor element and/or said donor element further comprises an adhesive layer applied on top of said acceptor element and/or said donor element.

13. Method according to claim 1 or 2 wherein said step (3) is performed by laminating the layers of said donor element and said acceptor element to each other by conveying them through a pair of rollers.

14. Method according to claim 1 or 2 wherein said laser exposure of step (4) is performed by a Nd-YAG laser, a Nd-YLF laser, a diode laser, or an array of these laser types.

15. Method according to claim 1 or 2 wherein said acceptor element further contains a toning agent.

16. Method according to claim 15 wherein said toning agent is 3,4-dihydro-2,4-dioxo-1,3,2H-benzoxazine.

* * * * *

UNITED STATES PATENT AND TRADEMARK OFFICE

CERTIFICATE OF CORRECTION

PATENT NO. : 5,595,854

DATED : January 21, 1997

INVENTOR(S) : Leenders et al.

It is certified that error appears in the above-indentified patent and that said Letters Patent is hereby corrected as shown below:

Title Page, Second Column, under "5,380,607" insert

--FOREIGN PATENT DOCUMENTS

0 582 144 A1 2/1994 European--;

Column 2, line 3, "differentiation" should read --differentiation in--;

Column 5, line 28, after "-NH-$SO_2R^{12}$," insert ---NH-$COR^{12}$,--;

Column 6, line 58, "oxonoldyes" should read --oxonol dyes--;

Column 17, line 2, "g/$m_2$" should read --g/$m^2$--;

Column 17, line 10, "4.9" should read --14.9--.

Signed and Sealed this

Twenty-fifth Day of November, 1997

*Attest:*

*Attesting Officer*

BRUCE LEHMAN

*Commissioner of Patents and Trademarks*